United States Patent [19]

Engelbart

[11] 4,351,457

[45] Sep. 28, 1982

[54] JACKET PRESSING APPARATUS

[75] Inventor: Wilhelm Engelbart, Boras, Sweden

[73] Assignee: Maskinfirma Certus AB, Ganghester, Sweden

[21] Appl. No.: 167,654

[22] Filed: Jul. 11, 1980

[51] Int. Cl.[3] ..... D06C 15/00

[52] U.S. Cl. ..... 223/57; 38/6; 38/144; 223/70; 223/73

[58] Field of Search ..... 223/57, 67, 70, 72, 223/73, 74; 38/12, 15, 66, 6, 144

[56] References Cited

U.S. PATENT DOCUMENTS

| | | | |
|---|---|---|---|
| 2,327,492 | 8/1943 | Braum | 223/57 |
| 2,353,741 | 7/1944 | Matthews et al. | 223/70 |
| 3,080,099 | 3/1963 | Albiez | 223/57 |
| 3,317,094 | 5/1967 | Schmid | 223/57 |
| 3,484,821 | 12/1969 | Campbell et al. | 223/73 |
| 3,749,292 | 7/1973 | Engelbart | 223/57 |
| 4,057,179 | 11/1977 | Everett | 223/73 |

*Primary Examiner*—Louis Rimrodt

*Attorney, Agent, or Firm*—Watson, Cole, Grindle & Watson

[57] ABSTRACT

An apparatus for pressing a jacket or the like includes a plurality of pressing heads and bucks whereby substantially one half of a jacket may be pressed automatically.

2 Claims, 22 Drawing Figures

44
32
46
26
14
22
20
24
12
42
34
38
36
40

44
30
28
46
14
20
24
18
12
42
34
38
36

44
30
46
26
14
16
18
24
12
10
38
20

18
44
30
46
14
16
20
24
12
42
34
38
40
36

FIG. 5
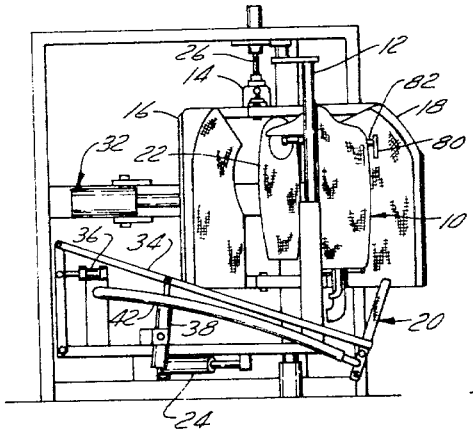
FIG. 6
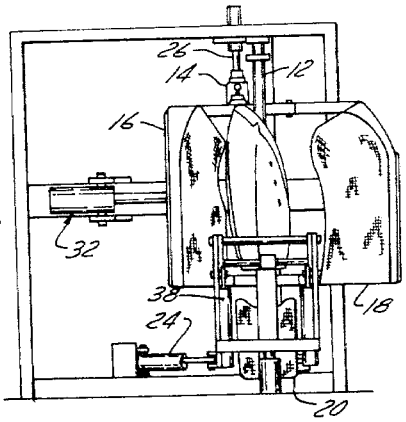
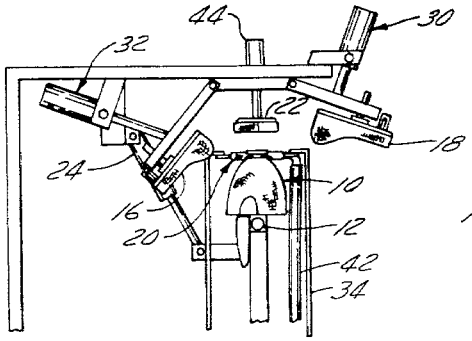
FIG. 7

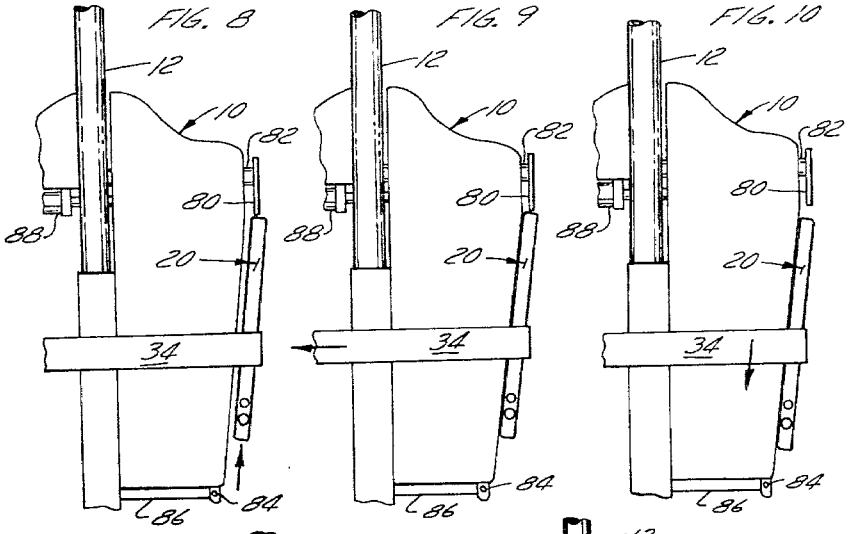
FIG. 8
FIG. 9
FIG. 10
12
10
82
80
88
20
34
84
86
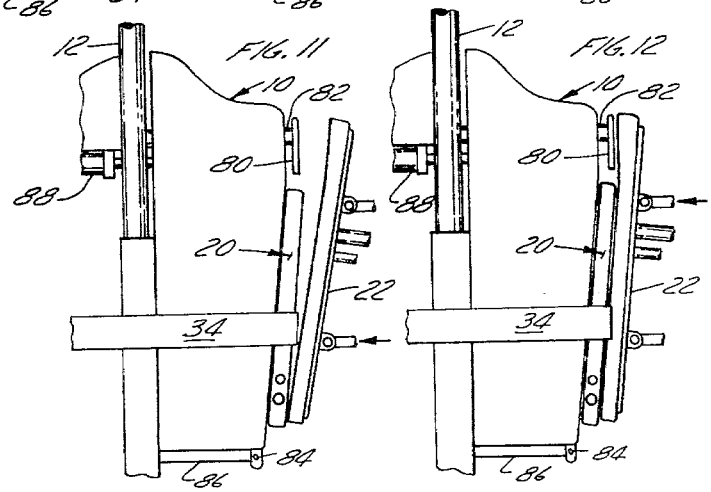
FIG. 11
FIG. 12
12
10
82
80
88
20
22
34
84
86
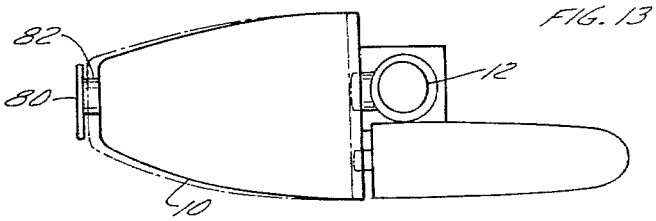
FIG. 13
82
80
12
10

FIG. 14
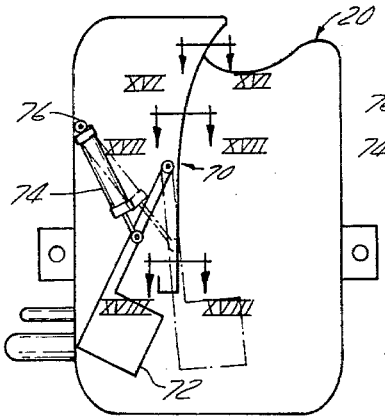
FIG. 15
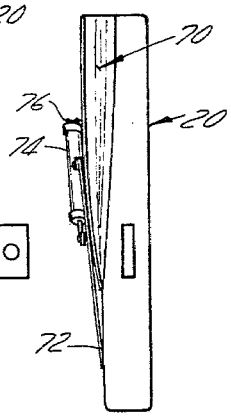
FIG. 16
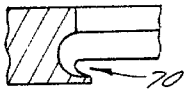
FIG. 17
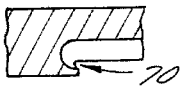
FIG. 18
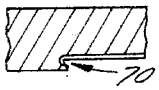
FIG. 19
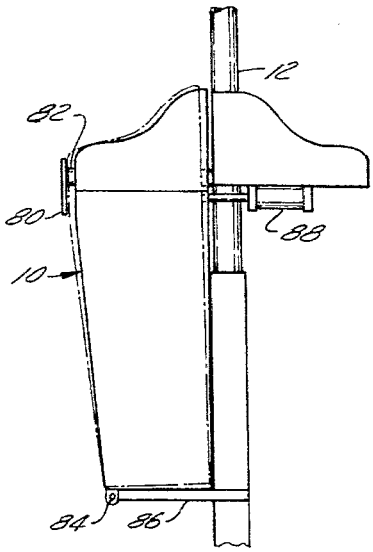
FIG. 20
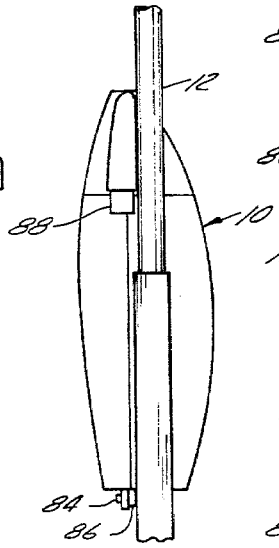
FIG. 21
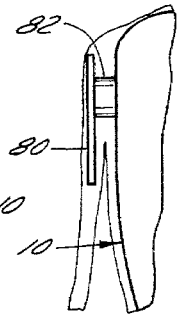
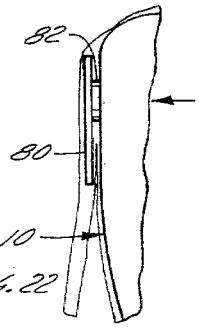
FIG. 22

JACKET PRESSING APPARATUS

The present invention relates to a garment pressing apparatus and more particularly relates to a pressing device for pressing jackets or the like.

After a garment such as a jacket is manufactured, it is normally then subjected to a pressing operation before subsequent delivery to a consumer outlet. Prior art apparatuses are known for carrying out various pressing operations and reference may be had, for example, to U.S. Pat. Nos. 3,317,094 to Schmid; 2,327,492 to Braun; 3,080,099 to Albiez; and many other references. However, to the best of applicant's knowledge, the prior art does not teach apparatuses which are able to press substantially one half of a jacket with a minimum of manual operations in the manner taught herein.

In accordance with one aspect of the present invention, applicant has devised a garment pressing apparatus which comprises a plurality of pressing means which are adapted to press a large portion of a jacket while the same is mounted on a body shaped buck. There is provided a first pressing head which is adapted to press one half of the front portion of the jacket; a second pressing head adapted to press one half of the back portion of a jacket; a side pressing head adapted to press one side of a jacket and serve as a buck for a sleeve pressing head for pressing the sleeve of the jacket.

In a further aspect of the present invention, there is provided a novel pressing means for pressing the underarm area of a jacket.

In a still further aspect of the present invention, there is provided a novel method and apparatus for pressing jacket sleeves whereby the sleeves are inflated with a gaseous material and subsequently a pressing head brought into contact with the inflated sleeve.

In a still further aspect of the present invention, there is provided a novel combined pressing head and buck for use in pressing the side and sleeves of a jacket.

In greater detail the apparatus includes a plurality of pressing heads and bucks which may be of a conventional structure and/or may employ modification discussed herein. In this respect, the term "pressing head" is generally employed to designate that portion of the pressing apparatus which is movable into and out of a pressing relationship with the jacket while the term "buck" is used in general terms to describe a pressing head which is stationary. However, it is understood that these terms may be used interchangeably and, for example, certain parts of the apparatus such as the body shaped buck may in one instance function as a buck and in a further instance as a pressing head.

As aforementioned, the pressing heads and bucks may be of a conventional structure and will thus include an outer wall surrounding an interior cavity, the outer wall being perforated or apertured and the interior cavity having air, steam and vacuum supplies associated therewith. The use of air, vacuum and steam is conventional in the art and need not be described in any detail herein. It suffices to say that various techniques are known to those skilled in the art for generating steam, vacuum and pressurized air.

Similarly, the means for moving the pressing heads into and out of a pressing relationship with the jacket are known and to this end, various hydraulic and pneumatic devices may be employed.

The apparatus preferably includes a body shaped buck upon which the jacket to be pressed is mounted.

The body shaped buck is adapted to conform to the configuration of one half of the jacket which is pressed at a single operating station. The pressing heads will include one for pressing the front half of the jacket, one for pressing the back half of the jacket, and one for pressing the shoulder area. A lapel and collar pressing head may also be included if so desired although this particular operation may be reserved for a separate unit in a subsequent operation. The apparatus will also include a side pressing head which also functions as a buck for the sleeve pressing operation in conjunction with a sleeve pressing head. Thus, one half of the jacket may be pressed in a single operation.

The body shaped buck is preferably formed of a plurality of sections such that should a style change require the same, one section can conveniently be replaced while the remaining sections stay the same. In practice, it preferred that the body shaped buck be formed of three sections—a front, back and shoulder section. Each section is preferably supplied with its own steam, vacuum and air connections. As is conventional in the art, the buck is provided with a fabric covering (as are the pressing heads).

The body shaped buck is preferably mounted in a manner such that it is rotatable through at least 90° for reasons which will become apparent hereinafter. After, the mounting of the buck in such a fashion can be achieved in many ways by those knowledgeable in the art. In addition, the buck is preferably structured so as to be movable outwardly in a manner such as to press the underarm area of a jacket in cooperation with a fixed buck as will be described in greater detail hereinbelow. In this respect, the body may be pivoted and hinged such that only a portion is movable outwardly or in the alternative, the entire body may be movable.

The front and back pressing heads are of a conventional structure and are adapted to press the respective portions of a jacket. The side pressing head is adapted to press the area between the areas pressed by the front and back pressing heads. While pressing the side of the jacket, the exteriorly facing surface of the side pressing head is adapted to serve as a buck for the pressing of the sleeve.

In one aspect of the invention, there is provided different means for pressing the sleeve of a jacket. It has long been recognized that obtaining a good press of the sleeve area is extremely difficult and in many instances, this operation has been performed manually.

According to one aspect of the present invention, a sleeve buck is provided which has a recess therein of a tapered arcuate cross-sectional configuration. The recess, as aforementioned, is arcuate in cross-section and increases in cross-sectional area from the portion adapted to receive the bottom of a sleeve to the upper portion thereof. The recess is adapted to receive the sleeve seam and in combination with the pressing operations described hereinbefore and following, a pressing of the seam can be obtained.

In one operation, the bottom of the sleeve of the jacket is sealed or closed off by suitable means (discussed hereinbelow) and a pressurized gaseous material (steam, air or a combination thereof) is blown into the sleeve to expand the same. A sleeve pressing head is then brought into contact one or more times with the expanded sleeve to remove any wrinkles and press the sleeve.

The means of sealing the sleeves at the bottom open end thereof may include several different means including a clip arrangement, or in the alternative, a special sleeve pressing head as will be discussed later.

In operation, the individual pressing heads/bucks may be operated in a known manner insofar as the use of vacuum to retain the garment thereon, the steaming of the garment and the use of air and/or vacuum. These are conventional steps employed by many such apparatuses.

Having thus generally described this invention, reference will be made to the accompanying drawings illustrating embodiments thereof, in which:

FIG. 5 is an end view of the apparatus as seen from the left hand side of FIG. 1;

FIG. 6 is an end view as seen from the left hand side of FIG. 2;

FIG. 7 is a top view of the apparatus;

FIGS. 8–12 are schematic views of the operation of the apparatus in pressing the side and sleeve of a garment;

FIG. 13 is a top view of a portion of the apparatus;

FIG. 14 is a detailed front elevational view of the buck for pressing sleeves;

FIG. 15 is a side view of the buck of FIG. 14;

FIGS. 16, 17 and 18 are cross-sectional views taken along lines XVI, XVII and XVIII respectively of FIG. 14;

FIG. 19 is a side elevational view showing movement of the body form seen in top view in FIG. 13;

FIG. 20 is an end elevational view of FIG. 19; and

FIGS. 21 and 22 are detailed views of a portion of the apparatus for pressing the underarm area of the jacket.

Figure 3:
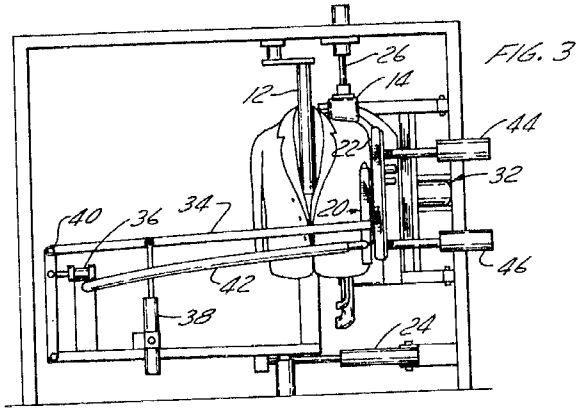
FIGS. 3 and 4 are front elevational views similar to FIG. 2 showing pressing operations.

Referring to the drawings in greater detail and by reference characters thereto, the apparatus includes one half of an upper torso shaped body form buck 10 mounted in a manner discussed hereinbelow on a central upright mounting member 12. Preferably, buck 10 is composed of a plurality of parts (not shown); in the preferred embodiment, form will consist of three or more parts comprising the front, back and shoulder parts to easily accommodate replacement of any one part.

Each of the buck parts may be of substantially conventional structure as is known in this art. Thus, each part would include an inner chamber to which steam, air and vacuum connections may be made. The walls of the parts are apertured to permit escape of the steam or air and to permit the applying of a vacuum.

The apparatus includes a plurality of pressing heads and/or bucks; specifically, there is provided a shoulder pressing head 14, a back pressing head 16, a front pressing head 18, a combined side pressing head and sleeve buck 20 and a sleeve pressing head 22.

Each of the aforementioned pressing heads or bucks is of a known structure; thus, there is provided an interior chamber surrounded by a perforated or apertured body. Suitable steam, air and vacuum connections are provided. As is conventional, a fabric covering may be provided for the pressing heads or bucks.

Figure 4:
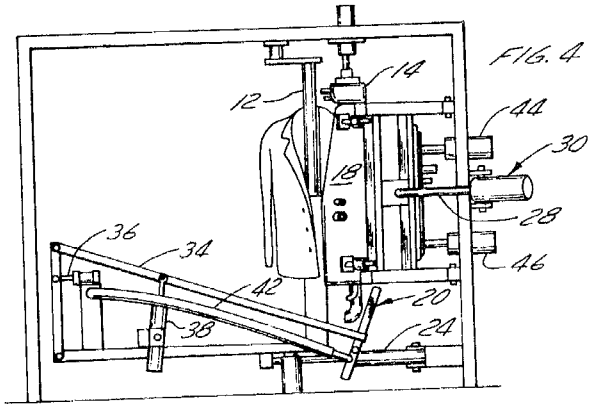
Figure 1:
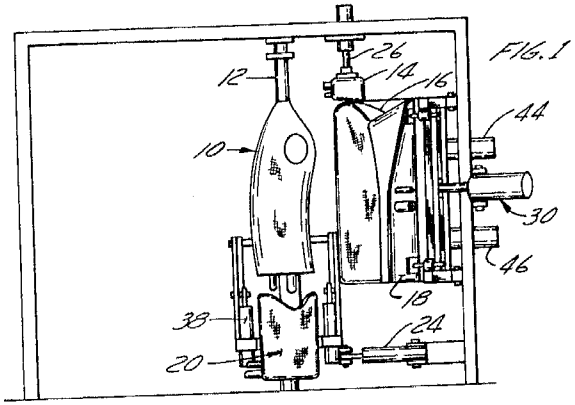
FIG. 1 is a side elevational view of the apparatus.
Figure 2:
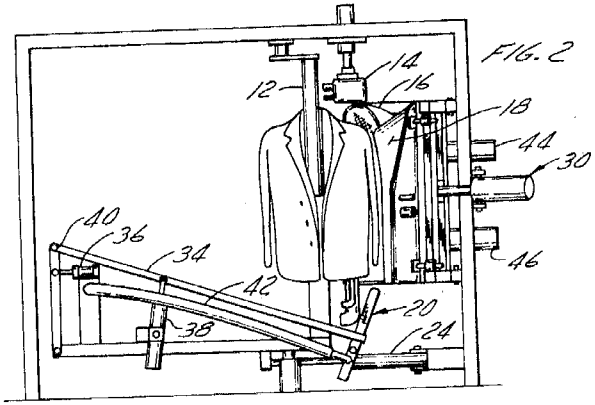
FIG. 2 is a front elevational view with a jacket loaded ready for pressing.

As may be seen from FIGS. 1 to 4, mounting member 12 upon which body buck 10 is mounted is rotatable through 90° such that the garment upon being mounted on form 10 in the loading position shown in FIG. 1, can be rotated through 90° to the pressing positions of FIGS. 2 through 4. Again, conventional means such as a piston assembly generally designated by reference numeral 24 may be employed for rotating body form 10 from the loading to a pressing position.

In greater detail, shoulder pressing head 14 is mounted on a suitable piston assembly 26 and is provided with vacuum, air and steam connections (not shown). In this instance, as in all of the pressing heads, steam generation may be augmented by the use of heated copper tubing within the pressing head or buck as the case may be. Front pressing head 18 is also movable into and out of a pressing relationship with the front of the jacket through mounting on a rod 28 of piston 30. The pressing position is illustrated in FIG. 4. A similar arrangement is provided for back pressing head 16 by means of a piston assembly 32. As may be seen in the drawings, a combined side pressing head and sleeve buck 20 mounted on arm 34 is movable in a horizontal direction through piston assembly 36 and in a vertical direction by means of piston assembly 38. Arm 34 is pivoted at point 40 as shown in FIG. 3. As is the case with all the pressing heads, suitable supply lines generally designated by reference numeral 42 are provided for steam, vacuum and air supplies.

Sleeve pressing head 22 has a pair of piston assemblies 44 and 46 associated therewith, the first piston assembly 44 being operative to move the upper portion of pressing head 22 into and out of the pressing relationship with the top portion of a sleeve of the garment and piston assembly 46 operative to move the lower portion of the pressing head 22 into and out of a pressing relationship with the lower part of the sleeve.

In operation, in general terms, a jacket is mounted on body buck 10 when in the position illustrated in FIG. 1. Subsequently, mounting member 12 is rotatably driven by piston assembly 24 through 90° to the position indicated in FIG. 2. Subsequently (or during the rotational movement), the armhole seam is pressed in a manner which will be discussed hereinbelow with respect to FIGS. 19 through 22. Following the armhole seam pressing, as shown in FIG. 3, shoulder pressing head 14 and side pressing head 20 are actuated to bring them into pressing position for their respective portions of the jacket. In this regard, the operation of pressing head 14 is substantially conventional; the operation of pressing head 20 is shown in schematic form in FIGS. 8 through 10 which will now be referred to.

Initially, piston assembly 38 is operated to move pressing head 20 upwardly by pivoting of arm 34 about pivot point 40 as shown in FIGS. 3 and 8. Pressing head 20 is moved upwardly to the desired position between the sleeve and side of the garment to be pressed. Subsequently, piston assembly 36 is activated to move arm 34 and pressing head 20 inwardly, as shown in FIG. 9, against the side of the garment. Following this operation, and as shown in FIG. 10, piston assembly 38 may again be activated to move pressing head 20 slightly downwardly while in engagement with the side of the garment to be pressed. This downward movement tensions the side of the4 jacket to provide a good press. In practice, the inward movement and downward movement of pressing head 20 may be done in a single operation; it will be understood that the downward movement is very slight and is only enough to tension the jacket.

With the pressing of the side of the jacket and with pressing head 20 in place, pressing of the sleeves may also take place. In this respect, pressing head 20, while performing as a head for pressing of the side of the garment also performs as a buck for the pressing of the sleeve. Preferably, pressing head 20 is divided into two sections interiorly; a first chamber providing steam, air and vacuum connections for the pressing head portion adapted to press the side of the jacket with a second chamber providing steam, air and vacuum connections for the buck portion against which the sleeve of the garment is placed.

The sleeve pressing operation, as shown schematically in FIGS. 11 and 12 may occur while pressing head 20 is in pressing engagement with the side of the jacket. In one embodiment of the sleeve pressing, and as shown in FIG. 11, the lower end of pressing head 22 is actuated through piston assembly 46 to bring the lower portion of the head into contact with the lower portion of the sleeve to be pressed. Subsequently, piston assembly 44 is activated to bring the upper portion of sleeve pressing head 22 into engagement with the upper portion of the sleeve of the garment. In practice, this sequential operation of the sleeve pressing head provides several advantages. Firstly, this movement tends to tension the sleeve of the garment and thus enables one to provide a better press to the sleeve. In addition, in certain embodiments of the invention, this sequential operation acts to seal off the bottom of the sleeve of the garment for reasons which will become apparent hereinafter.

Features of preferred embodiments of pressing buck 20 (the portion adapted to receive the sleeve of the garment) are shown in FIGS. 14 through 18 and will now be referred to.

FIG. 14 illustrates, in plan view, the "buck" side of the pressing member 20 or in other words, the side adapted to receive the sleeve of the garment to be pressed. As will be seen from FIGS. 15 to 18, the buck surface includes a tapered recess generally designated by reference numeral 70 and which recess is adapted to receive the seam of the sleeve to be pressed. Recess 70 increases in dimensions upwardly and has an arc-shaped configuration as may be seen from the cross-sectional views thereof.

In addition to the above recess 70, pressing member 20 may be provided with a clip member generally designated by reference numeral 72 adapted to hold the bottom portion of a sleeve which is to be pressed. Clip member 72 is movable into and out of a sleeve retaining position by means of a cylinder 74 pivoted at point 76. Thus, when the sleeve is to be pressed, it is placed on the surface of pressing member 22 with the sleeve seam fitting generally within recess 70. Clip member 72 will then be moved to the position shown in dotted lines in FIG. 14 to retain the end of the sleeve in a desired position. In one embodiment, sleeve pressing head 22 may then be operated in the manner discussed with respect to FIGS. 11 and 12—the bottom portion of pressing head 22 is then moved inwardly while retaining member 72 is moved by means of cylinder 74 to an out of the way position. The bottom portion of sleeve pressing head 22 then seals the end of the sleeve tightly against the buck 20.

In conjunction with the above, a pressing method may be used whereby a gaseous material is blown through the sleeve to "inflate" the same. This air blowing may be used in conjunction with the sealing of the end of the sleeve by clip member 72 and/or the use of special pressing head 22. The blowing of a gas forces the sleeve seam back into recess 70 and pressing head 22 may then be brought into an engagement with the sleeve to press the same against the interior pressure. If desired, a plurality of operations of this nature may occur to press the sleeve of the garment.

The pressing of the armhole seam is shown schematically in FIGS. 19 through 22 and reference will now be made thereto. Thus, the apparatus is provided with a pressing buck 80 which is secured by shaft 82 to mounting member 12. The pressing member or buck 80 is spaced slightly from body form 10 and is sized such that when the jacket is placed in a pressing position, the underarm area of the sleeve fits between pressing member 80 and body member 10. Body member 10 is pivotably mounted on supporting member 86 (secured to member 12) through pivot point 84. The upper portion of body 10 is thus movable outwardly for a slight distance on activation of piston assembly 88. Thus, upon mounting of the jacket to be pressed, as shown schematically in FIG. 21, piston assembly 88 is activated as seen in FIG. 22 to move body form 10 outwardly and thereby press the underarm area of the garment between pressing member 80 and body form 10. Subsequently, the remaining pressing operations as aforementioned may be performed with body member 10 in its outward position. Again, as in previous instances, pressing member 80 may be provided with suitable air, steam and vacuum means. The shape of pressing member 80 may conveniently be adapted to conform to the shape of the garment to be pressed; the illustration in the drawings is merely schematic for purposes of illustration.

It will be understood that the above described embodiments are for purposes of illustration only. Changes and modifications known to those skilled in the art can be made without departing from the spirit and scope of the invention. Furthermore, it is understood that some conventional components have been deleted for purposes of clarity.

Preferably, the apparatus is substantially automated and the pressing operations may be carried out in the desired sequence either through manual activation by the machine operator or in the alternative, by a programmed operation. Suitable controls are provided as is conventional in the art—i. e. separate vacuum, air and steam controls along with pressure variation controls may be provided. In an automated mode, the operator may place the jacket to be pressed on the buck and activate a vacuum to retain the jacket in the desired position and subsequently, all operations are effected automatically. If desired, a collar and lapel pressing head may be added to the apparatus.

I claim:

1. In a pressing apparatus which includes means for pressing the side and sleeves of a jacket, the improvement wherein the apparatus includes a body shaped buck adapted to receive at least a side half of the jacket, a combined side pressing head and sleeve buck, means for moving said combined head and buck upwardly from a first position to a position interposed between the side and sleeve of the jacket, means for moving the combined head and buck inwardly and slightly downwardly against a side of the jacket in a pressing relationship thereto, and pressing means adapted to move into and out of a pressing relationship with the sleeve of the jacket and the sleeve buck.

2. In a pressing apparatus which includes means for pressing the side and sleeves of a jacket, the improvement comprising a body shaped buck adapted to receive at least a side half of a jacket to be pressed, a combined side pressing head and sleeve buck adapted to move into and out of a pressing relationship with the side of the garment, a sleeve pressing head, means for moving said sleeve pressing head into and out of a pressing relationship with the sleeve of the garment and the sleeve buck, said means comprising means for initially moving a lower portion of the sleeve pressing head into a pressing relationship with the bottom of the sleeve and means to subsequently move the upper portion of the pressing head into a pressing relationship with the upper portion of the sleeve.

* * * * *